US011465785B1

(12) United States Patent
Dodgen

(10) Patent No.: US 11,465,785 B1
(45) Date of Patent: Oct. 11, 2022

(54) QUICK FILLING AND SELF SEALING FLUID STORAGE BAG ASSEMBLY

(71) Applicant: David M. Dodgen, Cedar Park, TX (US)

(72) Inventor: David M. Dodgen, Cedar Park, TX (US)

( * ) Notice: Subject to any disclaimer, the term of this patent is extended or adjusted under 35 U.S.C. 154(b) by 0 days.

(21) Appl. No.: 15/803,507

(22) Filed: Nov. 3, 2017

Related U.S. Application Data

(63) Continuation-in-part of application No. 14/093,377, filed on Nov. 29, 2013, now abandoned.

(60) Provisional application No. 61/731,112, filed on Nov. 29, 2012.

(51) Int. Cl.

| | |
|---|---|
| ***B65B 3/17*** | (2006.01) |
| ***B31B 70/855*** | (2017.01) |
| ***B31B 50/07*** | (2017.01) |
| ***B31B 50/06*** | (2017.01) |
| ***A45F 3/18*** | (2006.01) |
| ***A45F 5/10*** | (2006.01) |
| ***B31B 160/10*** | (2017.01) |
| ***B31B 150/00*** | (2017.01) |
| ***A45F 3/16*** | (2006.01) |

(52) U.S. Cl.
CPC ..... *B65B 3/17* (2013.01); *A45F 3/18* (2013.01); *B31B 50/064* (2017.08); *B31B 50/07* (2017.08); *B31B 70/855* (2017.08); *A45F 2003/166* (2013.01); *A45F 2005/1086* (2013.01); *B31B 2150/00* (2017.08); *B31B 2160/102* (2017.08)

(58) Field of Classification Search
CPC ..... B65B 3/17; B31B 50/064; B31B 2150/00; B31B 2160/102; B31B 50/07; B31B 70/855; A45F 2/18; A45F 2003/166; A45F 2005/1086; A45F 3/18
USPC ..... 141/10
See application file for complete search history.

(56) References Cited

U.S. PATENT DOCUMENTS

| | | | | |
|---|---|---|---|---|
| 172,039 | A * | 1/1876 | Lazarevitch | A61F 7/086 383/44 |
| 684,036 | A * | 10/1901 | Bates | B65B 1/18 141/10 |
| 2,273,128 | A * | 2/1942 | Madsen | A61F 7/08 383/91 |
| 2,584,632 | A * | 2/1952 | Southwick, Jr. | B29C 66/7292 156/289 |
| 2,653,744 | A * | 9/1953 | Behr | B68G 7/06 141/10 |
| 2,976,988 | A * | 3/1961 | Schneider | B65D 83/0481 206/445 |

(Continued)

*Primary Examiner* — Timothy L Maust
*Assistant Examiner* — James R Hakomaki
(74) *Attorney, Agent, or Firm* — Rick B. Yeager

(57) ABSTRACT

A fluid storage bag comprising a storage bag sealed to a collapsible quick filling and self-sealing fill tube. After partially filling the storage bag, through the fill tube, to a desired level with water or other liquid the storage bag is inverted, thereby collapsing and effectively sealing the fill tube against itself. After use, the storage bag may be re-filled, or recycled. In one example, a 4 inch wide fill tube extends at 6 inches into the storage bag, with the last 5 inches creating a funnel to a 2 inch bottom width. In other examples air or other gas may be introduced through the fill tube; and as the bag is pressurized, the fill tube collapses and seals so that the bag may serve as a flotation device, air mattress, pillow or other device.

11 Claims, 13 Drawing Sheets

(56) References Cited

U.S. PATENT DOCUMENTS 3,137,419 A * 6/1964 Davy ..... B65D 31/145 383/44
3,144,197 A * 8/1964 Milner ..... B65D 31/145 383/45
3,189,252 A * 6/1965 Miller ..... B65D 31/145 383/57
3,193,180 A * 7/1965 Lissner ..... B65D 31/14 383/50
3,197,073 A * 7/1965 Gondra ..... B65D 31/145 222/107
3,223,619 A * 12/1965 Calmon ..... C02F 1/002 210/667
3,263,903 A * 8/1966 Waller ..... B65D 31/145 383/44
3,313,472 A * 4/1967 Tjerneld ..... B65D 31/14 383/44
3,332,415 A * 7/1967 Erickson ..... A61F 5/05816 602/13
3,746,215 A * 7/1973 Ausnit ..... B65D 33/00 222/92
3,806,025 A * 4/1974 Marshall ..... B65D 31/14 383/49
4,196,030 A * 4/1980 Ausnit ..... B65D 75/5866 222/107
5,354,132 A * 10/1994 Young ..... A61J 19/00 383/44
5,356,398 A * 10/1994 Willis ..... A61G 9/006 600/573
5,692,546 A * 12/1997 Podd, Sr. ..... B65D 90/047 141/68
5,711,691 A * 1/1998 Damask ..... F16K 15/202 441/41
6,170,513 B1 * 1/2001 Lo ..... F16K 15/202 446/224
6,241,122 B1 * 6/2001 Araki ..... B65D 47/06 222/107
6,783,276 B2 * 8/2004 Machacek ..... B65D 33/2591 383/36
6,969,195 B2 * 11/2005 Ferranda ..... B65D 31/08 383/44
7,004,354 B2 * 2/2006 Harper ..... B65D 75/58 222/212
7,004,630 B2 * 2/2006 Piechocki ..... B65D 33/2525 383/36
7,581,371 B2 * 9/2009 Owensby ..... B65D 51/185 206/466
8,328,048 B2 * 12/2012 Tschantz ..... B65D 75/5883 222/105
8,622,877 B2 * 1/2014 Raines ..... A63B 21/06 383/44
8,708,003 B2 * 4/2014 Morris ..... B68G 7/06 141/10
8,753,845 B2 * 6/2014 Dhariwal ..... C12N 9/1276 435/91.1
2003/0146247 A1 * 8/2003 Oren ..... B65D 5/748 222/494
2008/0308578 A1 * 12/2008 Skillern ..... A45F 3/20 222/209

* cited by examiner

QUICK FILLING AND SELF SEALING FLUID STORAGE BAG ASSEMBLY

RELATED APPLICATIONS

This is a continuation-in-part of U.S. patent application Ser. No. 14/093,377 filed by applicant on Nov. 29, 2013 which is related to U.S. Provisional Patent Application No. 61/731,112 filed Nov. 29, 2012, and claims the benefit of that priority date.

BACKGROUND OF THE INVENTION

1. Field of Invention

This patent application relates to a container bag system with a quick filling and self-sealing fill tube, and more particularly to a fluid storage bag with a quick filling and self-sealing fill tube.

2. Prior Art

The prior art includes portable containers and larger water storage bags.

Prior Art Disposable Bags

U.S. Pat. No. 7,311,231 to Noell et al describes replacement or pre-filled bags with a shutoff or check valve provided on the exit port. In one embodiment, pre-filled bags are provided without the fill port. In another embodiment, bags have a fill port. In the case of user-filled replacement bags, this approach also appears to have the disadvantage of requiring portions of both the exit port assembly and the fill port assembly to be attached to the replacement bag.

Rigid Systems

U.S. Pat. No. 7,600,656 issued to Karl et al describes a rigid fluid container and cites problems with prior art bag designs: "While some improvements have been made in such bag-like systems, the reservoirs of these systems are often expensive and difficult to clean due to their construction. Flexible or "soft sided" reservoirs (e.g. bladders, bags, etc.) are typically constructed from two sheets of high grade plastic that are bonded or welded together along their edges to create a bag with water tight seams. These bags then have components attached to them for filling and dispensing fluids, such as an input port with a large threaded neck to fill the bag which ice and water, and an output spout with a bonded or welded drink tube. The resulting reservoir is typically a water-tight, though expensive, assemblage of fused or bonded parts. These assemblages usually have many internal seams and corners that are difficult to clean with conventional methods. For example, these collapsible bags typically include small voids or traps that are difficult to clean and often require accessories for facilitating proper cleaning (e.g. a hanging rack, etc.) to permit cleaning fluid access and/or air circulation. In some cases, the difficulties associated with cleaning the bag tend to outweigh the usefulness of the hydration bag as a desirable system for providing hydration to a user."

Disposable Bag and Sleeve Fastening Assembly

U.S. Pat. No. 8,182,151 to applicant, describes a hydration system with disposable bag and sleeve fastening assembly. Although this bag is primarily designed to be disposable, the concept works well as a reusable bag. In one embodiment, the current invention provides a collapsible flat poly fill tube for quick loading so that it is easier to fill and seal the disposable bag. This quick fill and self sealing feature makes it easier and quicker to fill and seal than any of the current backpack hydration systems on the market.

Two-Part Closure

U.S. Pat. No. 6,176,394 to Shimko et al describes a container according to a first embodiment includes a first panel bonded to all but a segment of an opposing second panel wherein the first and the second panels define an interior chamber and wherein the unbonded segments of the first panel and the second panel define a first opening having a maximum area. Present in the first opening is a two-part linear fluid impervious closure constructed of flexible material. The first part is bonded to the first panel segment of the first opening and the second part is bonded to the second panel segment of the first opening. A spout is bonded to at least the first panel to provide fluid communication between the interior chamber and the environment, and to define an orifice having an area less than the maximum area of the first opening. In a preferred embodiment, interlocking fastener strips are used as the closure. An alternative embodiment has both panels wholly bonded together at their common periphery and a slit in the first panel defines the first opening into which the closure is located and bonded. Methods for making the containers include the steps of locating the closure in the opening and using heat and pressure to effectuate the bonds. Additional heat and pressure is applied to the longitudinal ends of the closure to cause the same to become fused and to cause extrusion of closure material into any gaps that may be present between the closure and the perimeter bonds of the panels.

Aquapodkit™

The Aquapodkit™ provides temporary emergency water storage for use in bathtubs during emergency situations. The reusable fastening/locking/dispensing sleeve device of the Aquapodkit attaches to a disposable bladder. The sleeve device is designed to accommodate a pump or siphoning device to dispense the water as needed. The Aquapodkit is designed for a large volume of family emergency water storage.

The present invention can also be added as an enhancement to the Aquapodkit to store water in bathtubs to store water for emergency situations.

Storage Bag Sealing after Filling Through Collapsible Tube

Moretti, Application No. GB5814332 describes using a collapsible fill tube that extends to near the bottom of the storage bag, and then sealing the top of the storage bag. After filling the storage bag through the fill tube, the top of the fill tube is thrust into the storage bag, and the mouth of the storage bag is closed by heat sealing. The object of the fill tube is to prevent contamination of the mouth of the storage bag prior to heat sealing.

SUMMARY OF INVENTION

The present invention provides an easier and faster way of filling and sealing a fluid storage container such as an emergency liquid storage container.

In one embodiment, the present invention comprises a disposable liquid storage bag, with a collapsible self sealing fill tube, with an optional spout, valve, re-sealing two part closure, tear section, or access port. In one example, a liquid storage bag and the flat fill tube are provided as polymers, polyethylene, polypropylene, or other polymer or polymer blend. In this embodiment, the present invention provides an easier and safer method of sealing and protecting the contents of the liquid storage container. In one example, the delivery fittings are detachable and re-usable so that the storage bag and fill tube assembly is curbside recyclable.

The water container assembly may be housed inside a box or other container, or may be stacked on other water container assemblies.

In one example, the collapsible self sealing fill tube is provided as a flat polymeric tubing that is sealed across the top of a flat polymeric storage bag. Only the outside of the polymeric fill tubing is sealed to the storage bag, thereby leaving the inner portion of the storage bag and the inner portion of the fill tubing opened for filling (FIG. 5). An upper portion of the flat polymeric fill tube extends outside of the storage bag that is being filled, while the lower portion of the fill tube that extends inside the storage bag tapers and funnels liquids or other materials into the storage bag (FIG. 2). This tapering makes it easier to collapse the fill tube after filling, and provides a better seal. The flexible and pliable inner fill tube provides both convenient filling and a low-cost and rapid seal. Once filled and quickly turned upside down, the inner tubing collapses, thereby sealing the bag (FIG. 6) while still having outer extended portion (that can be folded down when contents are in bag). This folded down upper portion is available for quick refilling while in use (FIG. 5).

In another example, optional water delivery fittings may be cut out and recycled separately from the storage bag.

The components of the quick loading/filling bladder include a fill tube (FIG. 1B) with opening at top and funneled bottom which are sealed to a storage bag (FIG. 1A). This two-piece bag system is used to create a quick filling opening at the top of the storage bag. Once filled, the collapsible fill tube creates a secure seal to the storage bag for emergency drinking water or for other storage applications.

Directions for use include inserting the neck of the fill tube under a faucet, container or any other filling apparatus that you are pouring into the storage bag to eliminate any spilling (FIG. 5). After filling the storage bag to a desired level, quickly flip the storage bag over to have inner funneled part of bag collapse and stick together, thereby creating a leak proof or leak-resistant seal to protect the contents in the storage bag (FIG. 6). Although this seal has proved to be very reliable in both strength and vibration testing, a secondary seal can be provided by folding over or attaching a clip or other seal apparatus to the portion of the fill tube outside of the storage bag.

The quick loading/filling bag can accommodate larger or smaller storage containers and a variety of liquids. While this invention has been designed to accommodate the hydration system with disposable bag and sleeve fastening system, it could also accommodate the Aquapodkit™ or other storage applications.

The fill tube can also be used to enhance current hydration systems on the market that are not disposable. The storage bag can be of varying sizes containing liquids using the siphoning device and granular-type solids. The storage bag can be made in varying sizes to accommodate the container and contents and in varying materials. The storage bag can also connect to other fasteners, tubes and hoses for dispensing.

The fluid storage bag and fill tube can be used to store potable water, fluids, liquids, concentrates, spices, sauces, lotions, oils, cereals, grains, salt, etc. The current invention is not limited to the aforementioned contents.

The current invention can also accommodate multiple quick loading ports for filling and or separation of certain materials/liquids, such as epoxies, before combining.

The fluid storage bag and fill tube can be placed or stored in anything that can support its weight. The fluid storage bag may be constructed of thicker outer materials while the inner fill tube is still very flexible and collapsible for filling, thereby providing a check valve type of operation. Possible storage places include, but are not limited to: bathtubs, sinks, crates, drums, barrels, containers, coolers, storage tanks, tubs, tanker trucks, bulk containers, backpacks, carrying bags, and fanny packs.

In other examples, a pump, a pump filter, or a suction filter may be used to withdraw water through the fill tube of a fluid storage bag.

In other examples, solids or other materials may be introduced through the fill tube of the fluid storage container in order to mix with water. The mixed substance may be withdrawn through the fill tube or by cutting or puncturing the fluid storage bag.

In other embodiments, air is the fluid which is stored in the fluid storage bag, and the fluid storage container provides a low cost and recyclable container that can serve as a flotation device, raft, air mattress, travel or camping pillow, or other device. An unexpected feature of the fluid storage bag is that when the container is pressurized, the fill tube resists leakage of a gas or liquid even when external pressure is applied. This feature permits a simple and inexpensive fluid storage bag to be provided in a wide range of sizes and to serve a number of useful functions and then be completely recycled.

By providing more efficient and economical filling, sealing, and storage, the current invention permits the consumer to replace the bags only.

DETAILED DESCRIPTION OF EMBODIMENT

In one example, a water container comprises a fluid storage bag with a top portion and a bottom portion; a collapsible fill tube positioned partially within the storage bag, and an optional access element.

The collapsible fill tube has a first panel, a second panel, a top having a width, and a funnel shaped bottom portion having a bottom opening with a width less than the top width. The first panel has an inside surface, a first side edge, and a second side edge. The second panel has an inside surface, a first side edge, and a second side edge. The first panel is connected to the second panel at the first fill tube side edge and the second fill tube side edge. An upper portion of the collapsible fill tube extends through top portion of the storage bag. A storage bag top seal is provided, in proximity to the top of the storage bag, between the storage bag and the collapsible fill tube.

Storage Bag

Figure 1A:
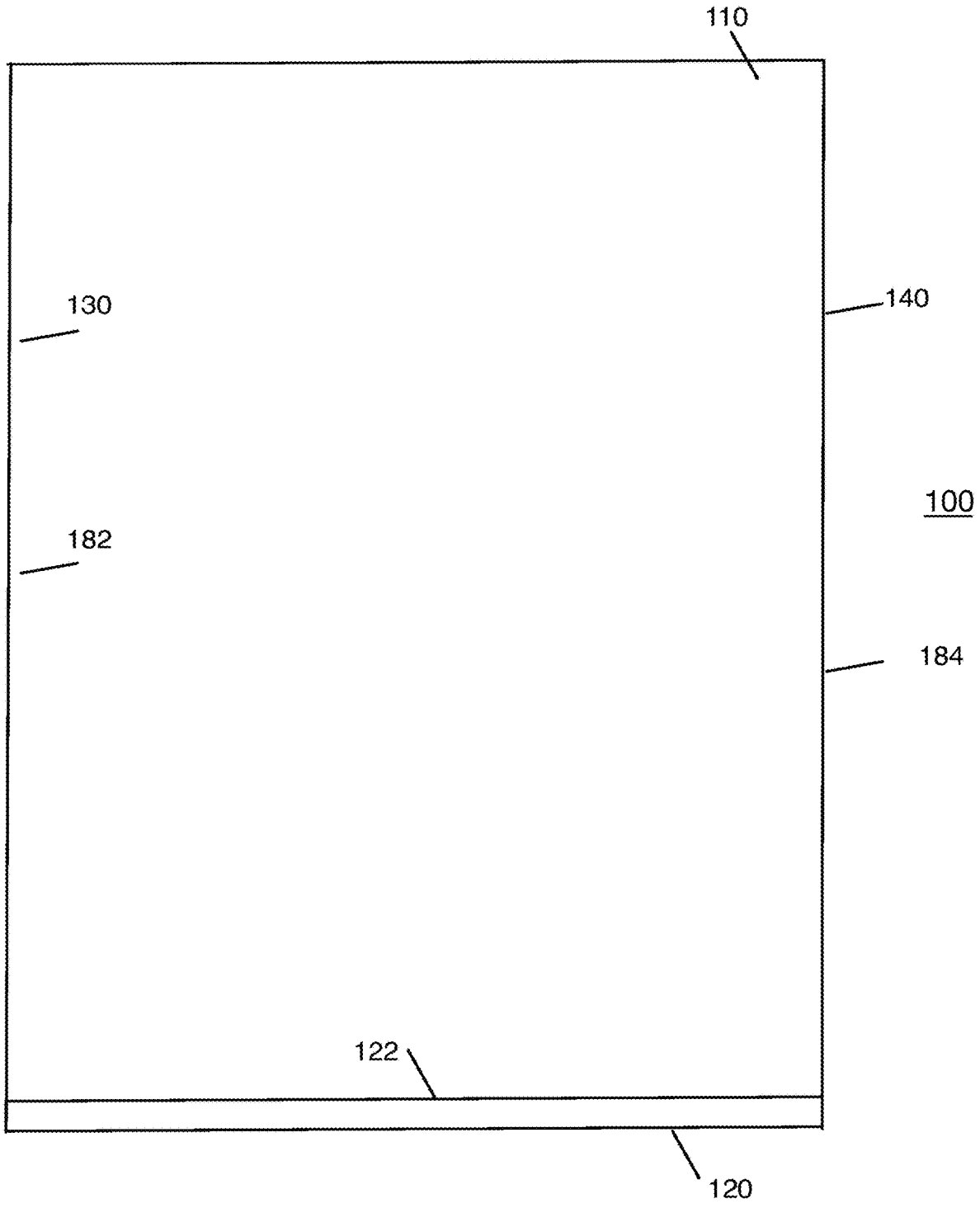
FIG. 1A shows a storage bag.

FIG. 1A is a side view of a storage bag 100 with a top 110, a bottom 120 with a bottom seal 122, a first side edge 130, and a second side edge 140.

In this specification, the term "fluid" refers to a liquid or gas.

In this specification, the term "fluid storage bag" refers to a storage bag for a liquid or gas.

In this specification, the terms "liquid storage bag" or "water storage bag" refers to a container for storing emergency drinking water, other liquids, granular or powdered solid, or a mixture of a liquid and a solid.

In one example, the storage bags are fabricated from two panels 150 and 160 with double side heat seal seams 170 and 172, a bottom heat seal seam 174, and heat seal seams 182 and 184 across the top portion.

In another example, the storage bags are fabricated by folding a strip of sheet material 152 upon itself to form a folded edge 153 and sealing the meeting side edges 154 and 156 together to form a side seam 157. The bottom and top edges are sealed after the material is folded.

Fill Tube

Figure 1B:
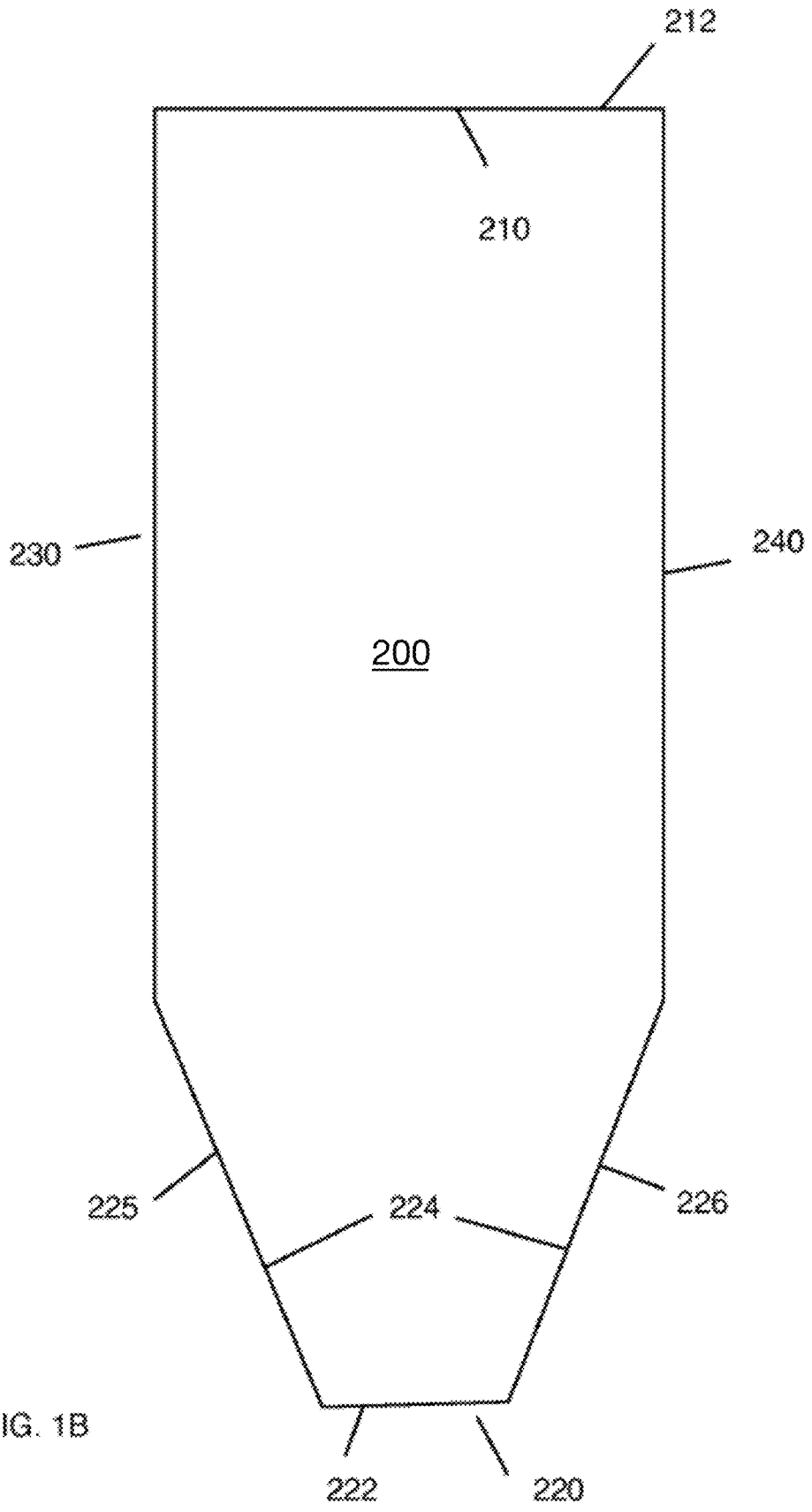
FIG. 1B shows the smaller flat fill tube with a larger filling port and a tapered extension which funnels the liquid/material into the larger storage bag of FIG. 1A.

FIG. 1B is a side view of a fill tube 200 with a top 210, a bottom 220, a first side edge 230, and a second side edge 240. The top comprises a top opening 212. The bottom comprises a bottom opening 222 and a bottom taper 224. In other examples, the bottom of the fill tube is not tapered. The fill tube may be fabricated by overlaying a first panel and a second panel and then creating seals along first side panel edges 230 and the second side panel edges 240. It is desirable to make the funnel seals 225 and 226 with the panel edges well-aligned and with as flat of seam as practical.

In this specification, the term "fill tube" refers to an element having a first side and a second side, with seals, creases, and/or folds between the edges of the first side and the edges of the second side; such that in a closed configuration, the first side lays flat against the second side; and in an open configuration the first side is at least partially spaced away from the second side to permit the flow of liquid, solid, or a mixture of liquid and solid between the first side and the second side.

In this specification, the term "collapsible fill tube" refers to a fill tube having a first side and a second side where the inside portion of first side and the inside portion of the second side are in substantial contact, thereby preventing the flow of a liquid, powder, granules, other solid, or mixture of liquid and solid for flowing between the first side and second side.

In this specification, the term "funnel portion" refers to a narrowing of the fill tube from a top width to a bottom opening substantially narrower than the top width.

Assembled Storage Bag and Fill Tube

Figure 2B:
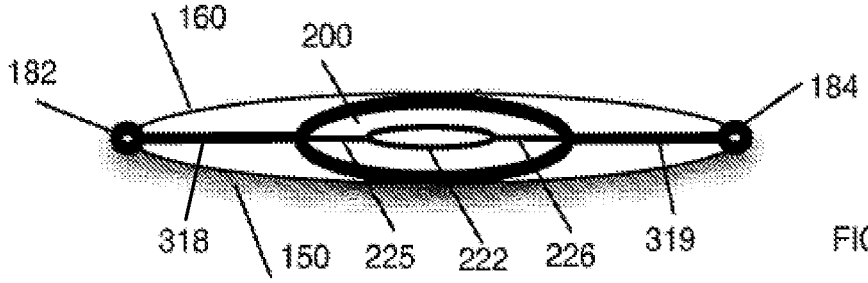
FIG. 2B is a top view of the water container of FIG. 2A.
Figure 2A:
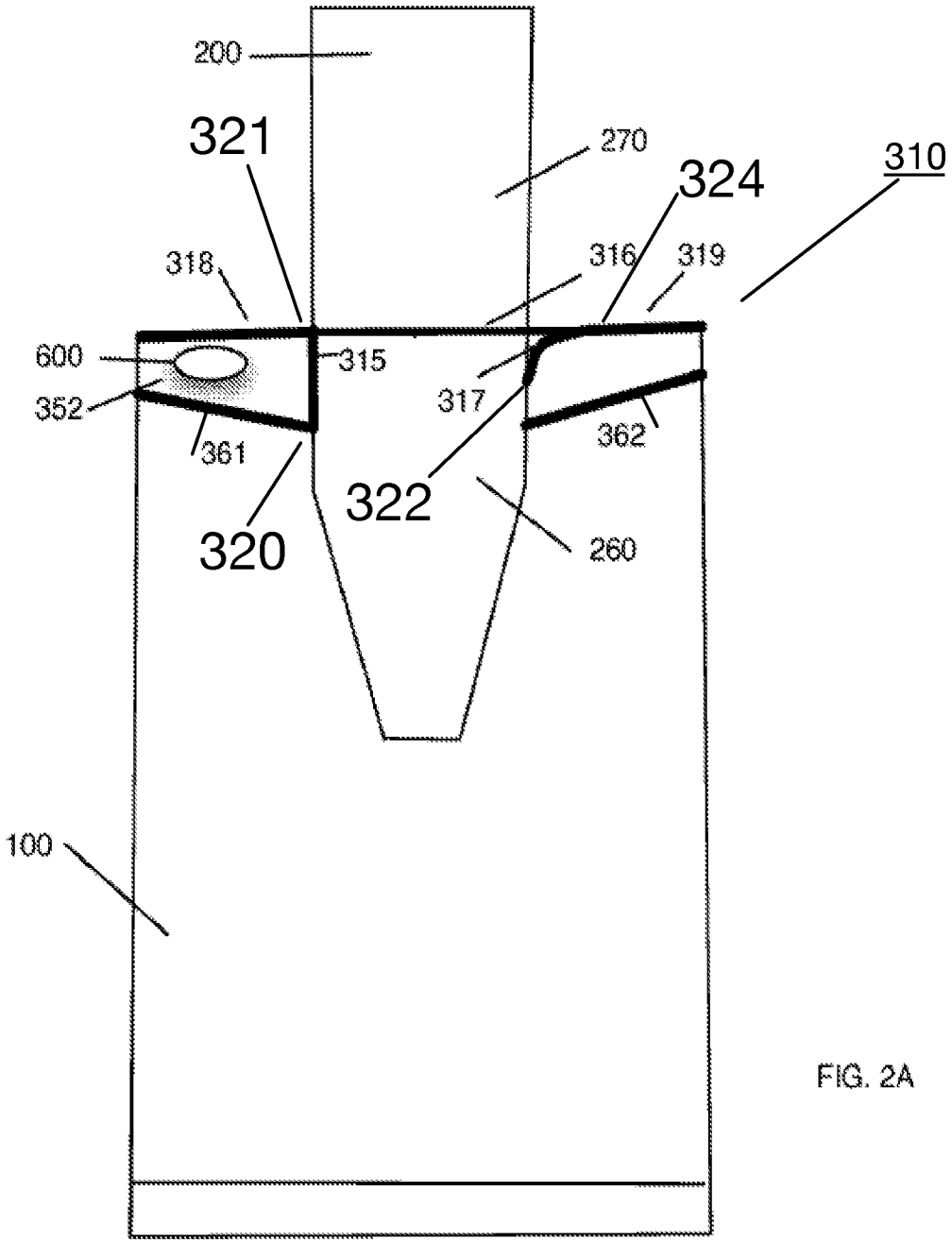
FIG. 2A shows the fill tube of FIG. 1B assembled in the fluid storage bag of FIG. 1A to form a water container.

FIG. 2A shows the fill tube 200 of FIG. 1B assembled in the storage bag 100 of FIG. 1A to form a water storage bag or container 310. A lower portion 260 of the fill tube extends into the storage bag 100. An upper portion 270 of the fill tube extends outwardly from the storage bag. A slot seal 316 is provided on the outside of the fill tube to seal the fill tube to the storage bag along the top of the storage bag, leaving the inner portion of the storage bag and fill tubing opened for filling.

In FIG. 2A, the storage bag top seal includes fill tube inversion preventers 315 and 317 that are formed by heat sealing a first upwardly-convex inversion seal extending between a first point 320 on the fill tube below the top of the bag, and a second point 321 in proximity to the top of the storage bag that is wider than the fill tube, and heat sealing a second upwardly-convex inversion seal extending between a third point 322 on the fill tube below the top of the bag, and a fourth point 324 in proximity to the top of the storage bag that is wider that the fill tube. A heat seal 316 is formed between the second point and the fourth point, such that the heat seal seals the flat tubing to the first panel of the storage bag and to the second panel of the storage bag.

Figure 4:
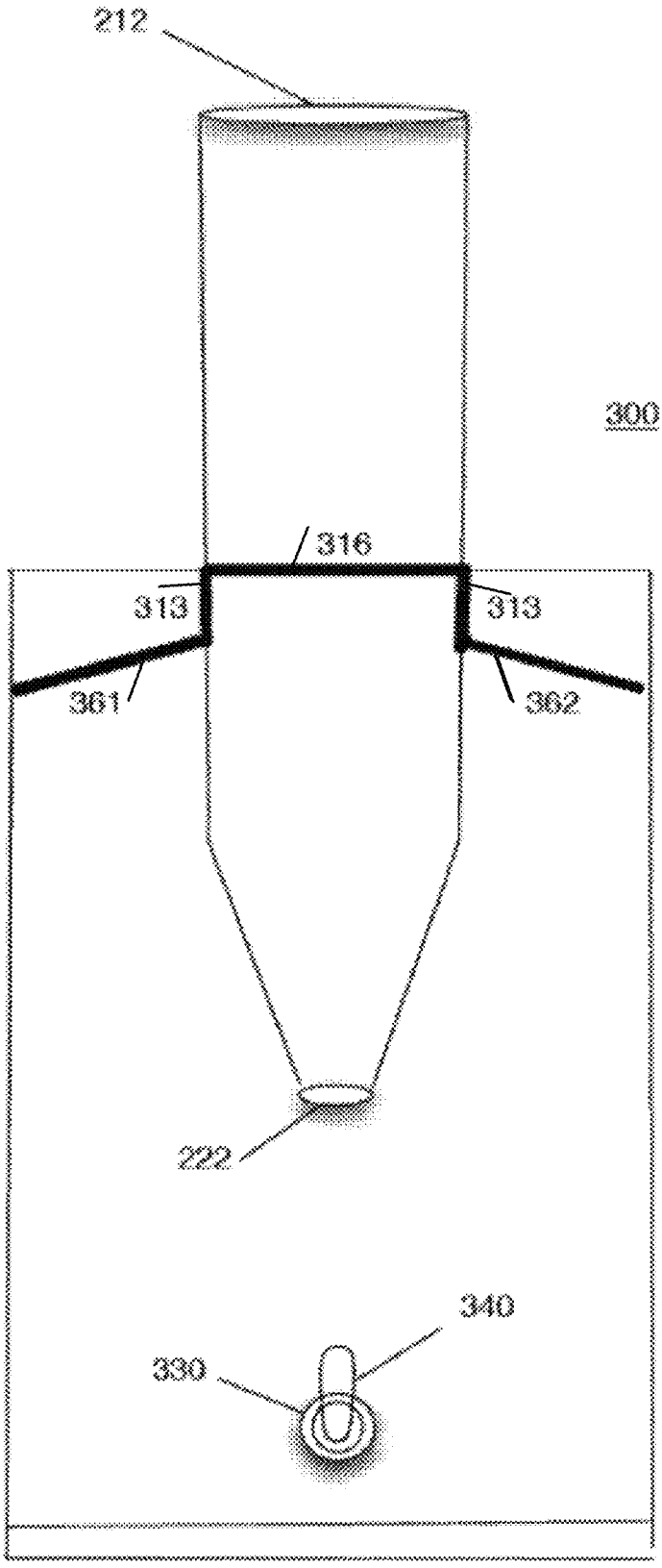
FIG. 4 shows the water container of FIG. 3 with an access element inserted in the access element hole.
Figure 12:
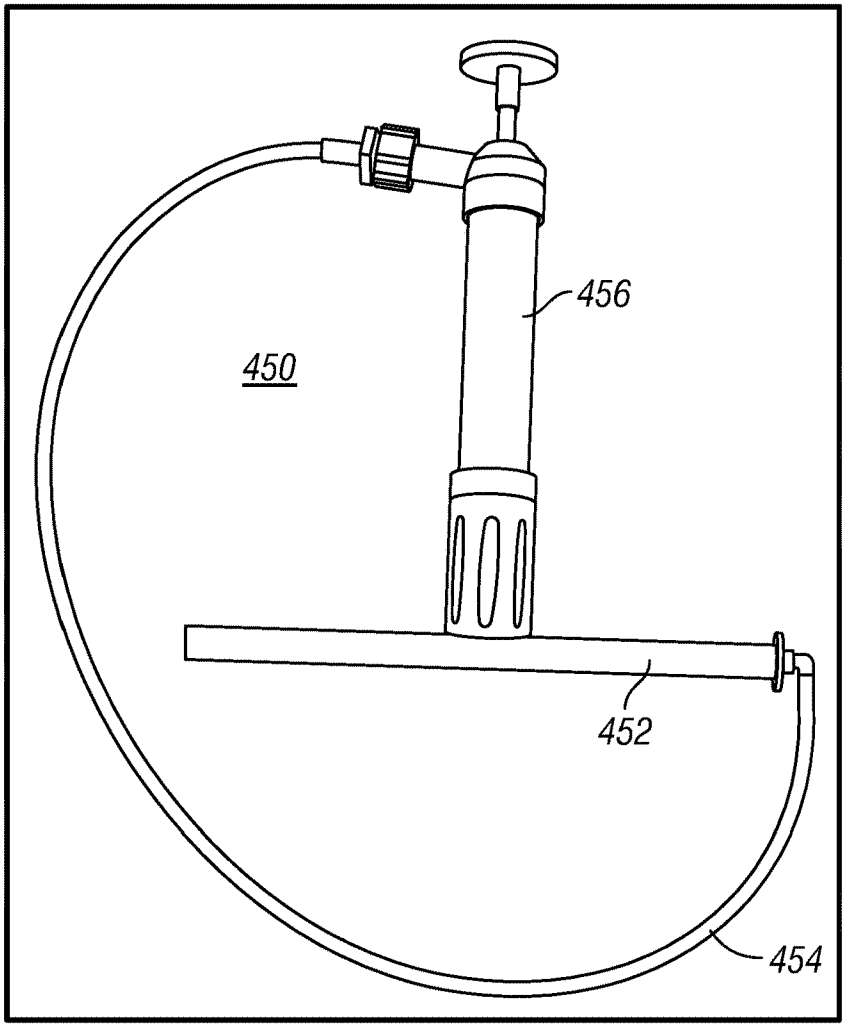
FIG. 12 is a top view of a pump and filter.

In other examples, the top bag seal includes a heat seal 316 to seal the flat tubing to the first panel of the storage bag and to the second panel of the storage bag; and seals 361 and 362 which are provided below the top of the storage bag and preferably angle upwards toward the sides of the storage bag. When these seals 361 and 362 are used the fill tube inversion preventers may be straight sections 313 as shown in FIG. 12 and FIG. 4 which extend downward from the top seal 316 to intersect the seals 361 and 362.

The top seal 316 has extensions 318 and 319 so that the seals 316, 318, and 319 extend across the top the of the storage bag from the first side edge to the second side edge of the storage bag, respectively. In FIG. 2A, a handle is provided in the unfilled area 352 between the fill tube and the second side of the storage bag.

FIG. 2B is a top view of the container of FIG. 2A. The heavy lines represents the top seal 316 between the storage bag and the fill tube 200, which is shown partially open for illustration, and the seals 318 and 319 which seal the top of the storage bag. The storage bag front panel 150 and rear panel 160 are shown separated below the seal for illustration, with storage bag side heat seals 182 and 184 exaggerated for illustration. The fill tube typically has similar construction with a front panel and a rear panel with good alignment and a flat seal at the edges. The top view shows the bottom opening 222, and funnel edge seals 225 and 226.

Example

An example that has been effective for containers is with a fill tube about 4 inches wide with a 5 inch long funnel which narrows to a 2 inch opening (which is large enough for ice cubes). The fill tube extends 6 inches into the storage bag. The fill line is below the bottom of the funnel. The air above the fill line may be bled through an closable access element.

Handle

A handle 600 may be formed above the storage bag seal such as illustrated in FIG. 2A. The handle portion and top of the storage bag may be reinforced with a polymer, tape, cardboard, or other material.

Gusseted Storage Bag

The storage bag may be gusseted, such as gusseted along the bottom to allow the storage bag to be free-standing when filled.

Access Element

Figure 3:
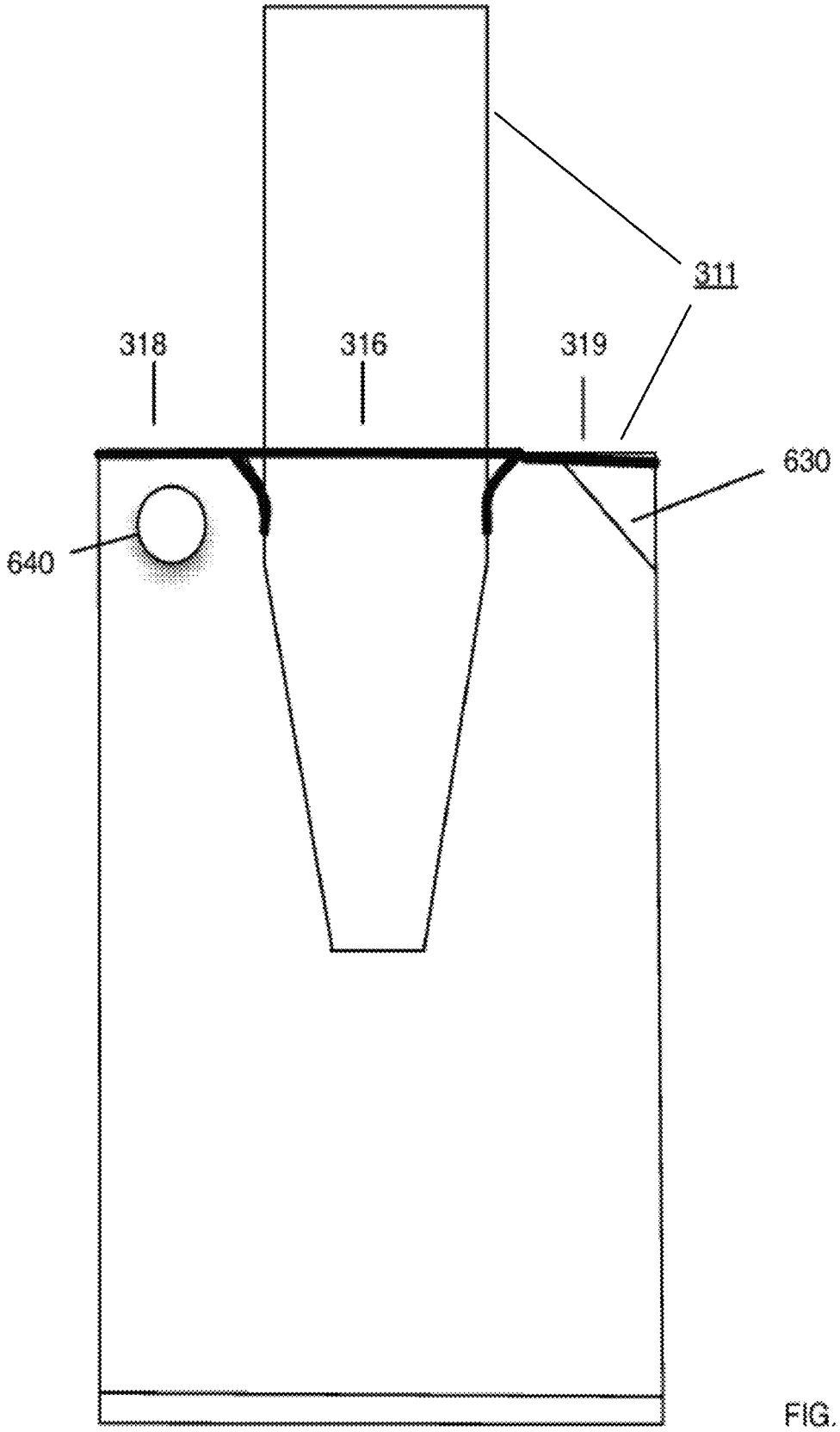
FIG. 3 shows the water container of FIG. 2 with an access element hole for inserting a spout, pump, or other dispenser.

FIG. 3 shows a container 311 of FIG. 2 an closable access element 630 for bleeding air or removing contents from the storage bag.

In this specification, the term "closable access element" refers to a spout, cap, valve, plug, or two part closure. An example of an irreversible access element is a cut or tear line.

In one example, a two part closure is provided along a portion of the top of the storage bag.

In another example, an access port is provided, and the port is sealed with a cap, valve, or plug.

In another example, the access element is a cut to the storage bag, typically in a corner of the bag such as illustrated by line 630 in FIG. 3. The preferred cut line may be marked on the bag, and the bag material may be weakened along the cut line.

Orientation of the Fill Tube

In the examples shown, the fill tube is provided in the center of the storage bag. In other examples, the fill tube may be offset to one side of the storage bag. Testing has shown that the fill tube should not be located too close to the edges of the storage bag.

In this example, a container is formed from a larger flat polymeric storage bag (FIG. 1A) and a smaller flat collapsible polymeric fill tube (FIG. 1B) which has a larger filling port and a tapered extension which funnels the liquid/material into the larger storage bag.

FIG. 4 shows a container assembly 300 formed with a port and cap mechanism 340. FIG. 4 shows storage bag seals 361, 362, and 316 with straight extensions 313, an access port 330 and a valve 340.

Figure 5:
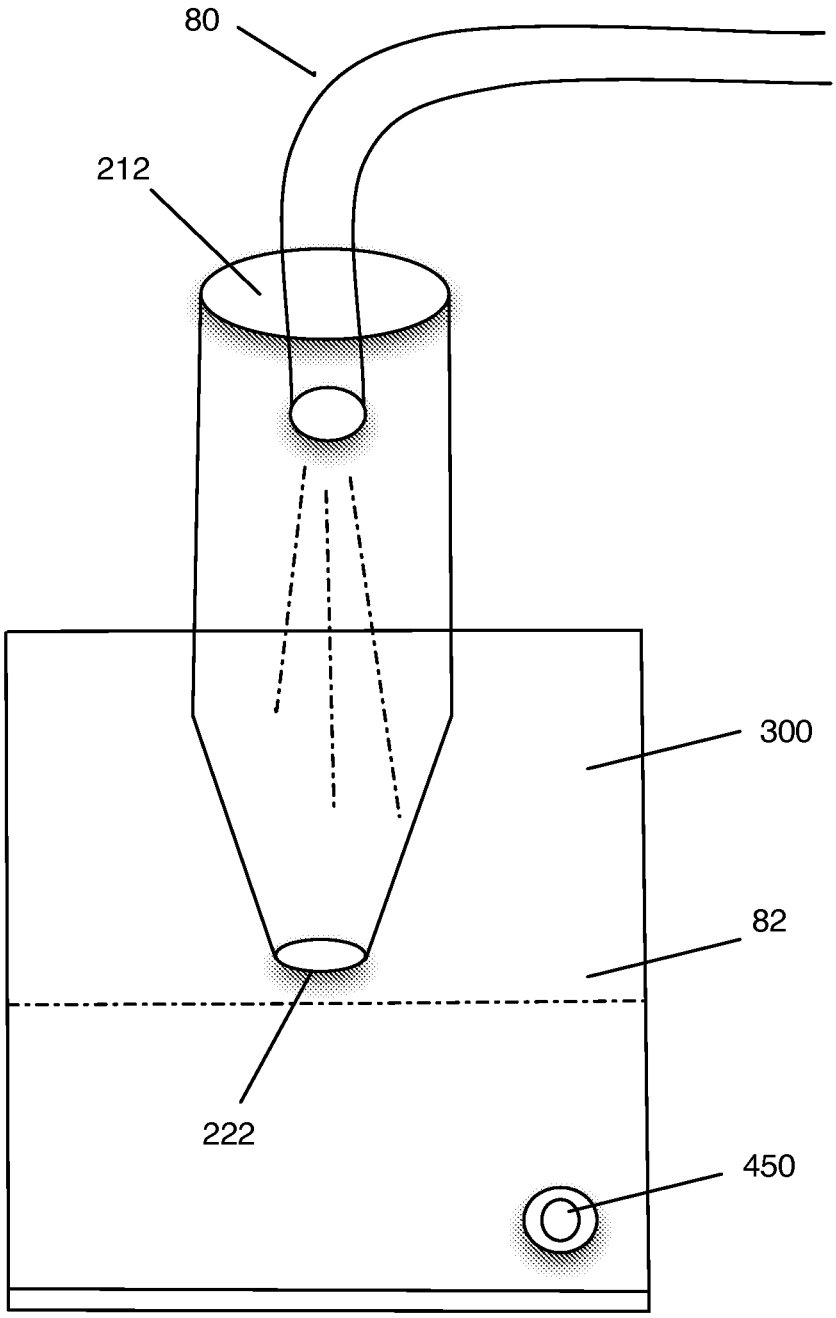
FIG. 5 shows the water container of FIG. 4 being filled for dispensing.
Figure 7:
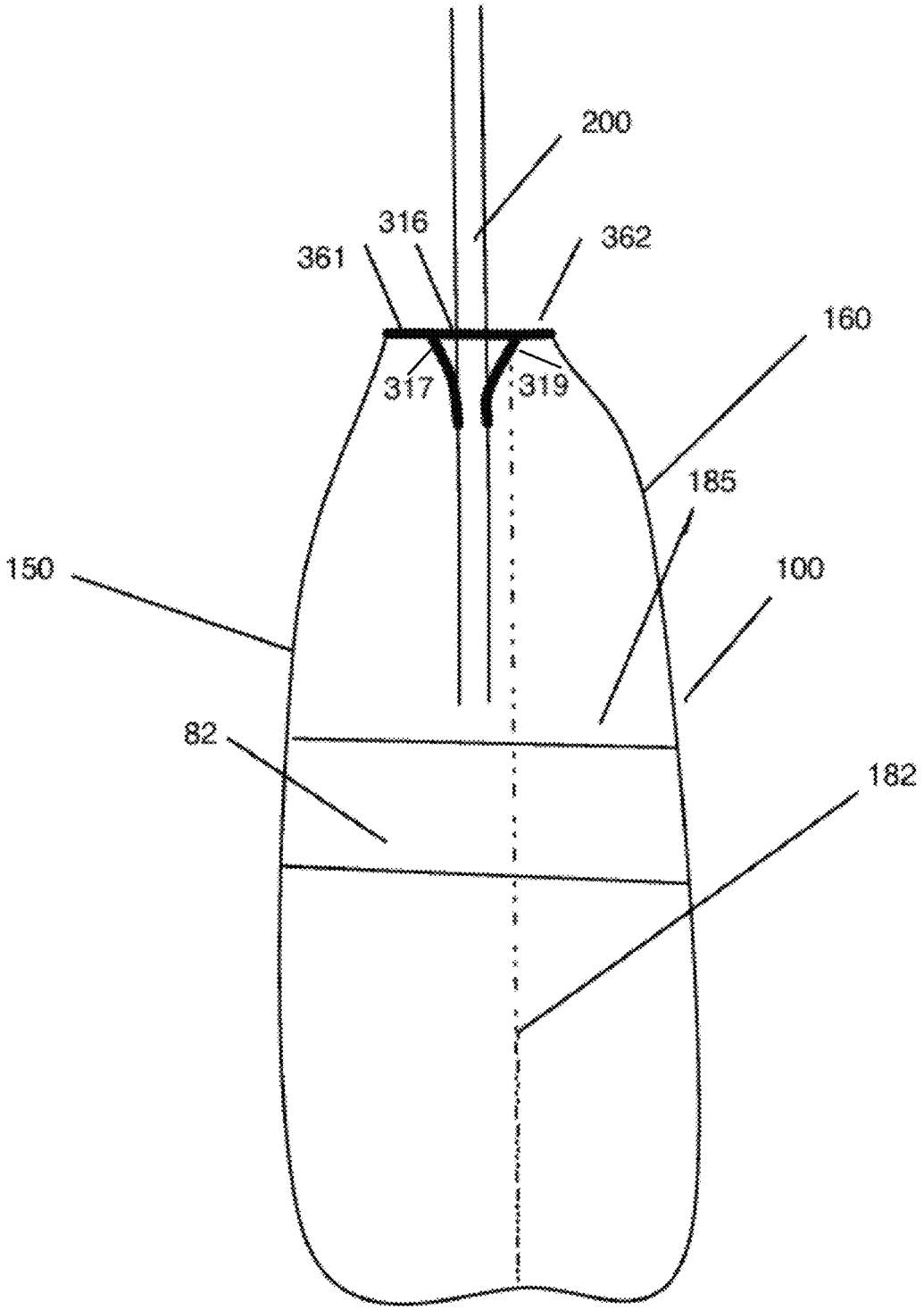
FIG. 7 is a vertical cross section view of the fill tube and fluid storage bag when the fluid storage bag is partially filled, as a liquid is introduced to the storage bag.

FIG. 5 shows a container assembly 300 formed by of FIG. 4 being filled for dispensing. In this example, the storage back is filled with water through a faucet 80 which provides water through the top opening 212 of fill tube 200. Referring to FIG. 7 which is a cross section view of the fill tube and storage bag, as a liquid is introduced to the storage bag, liquid will fall to the bottom of the storage bag and cause separation between the front panel 150 and the rear panel 160 of the storage bag. This separation may cause air to enter the storage bag through the fill tube. As described below, some or all of the air that is introduced through the fill tube may be removed by venting air out of the port 330. In this example, a stopper 450 is provided to bleed air and remove contents.

FIG. 5 shows the fill tube in condition for filling. The upper portion 270 of the fill tube 200 is opened up to permit introduction of the fill material. In this figure, water has filled the storage bag to level 82. A fill line 185 may be used to indicate the ultimate desired level of the storage bag liquid contents before air is removed as described below.

Figure 8:
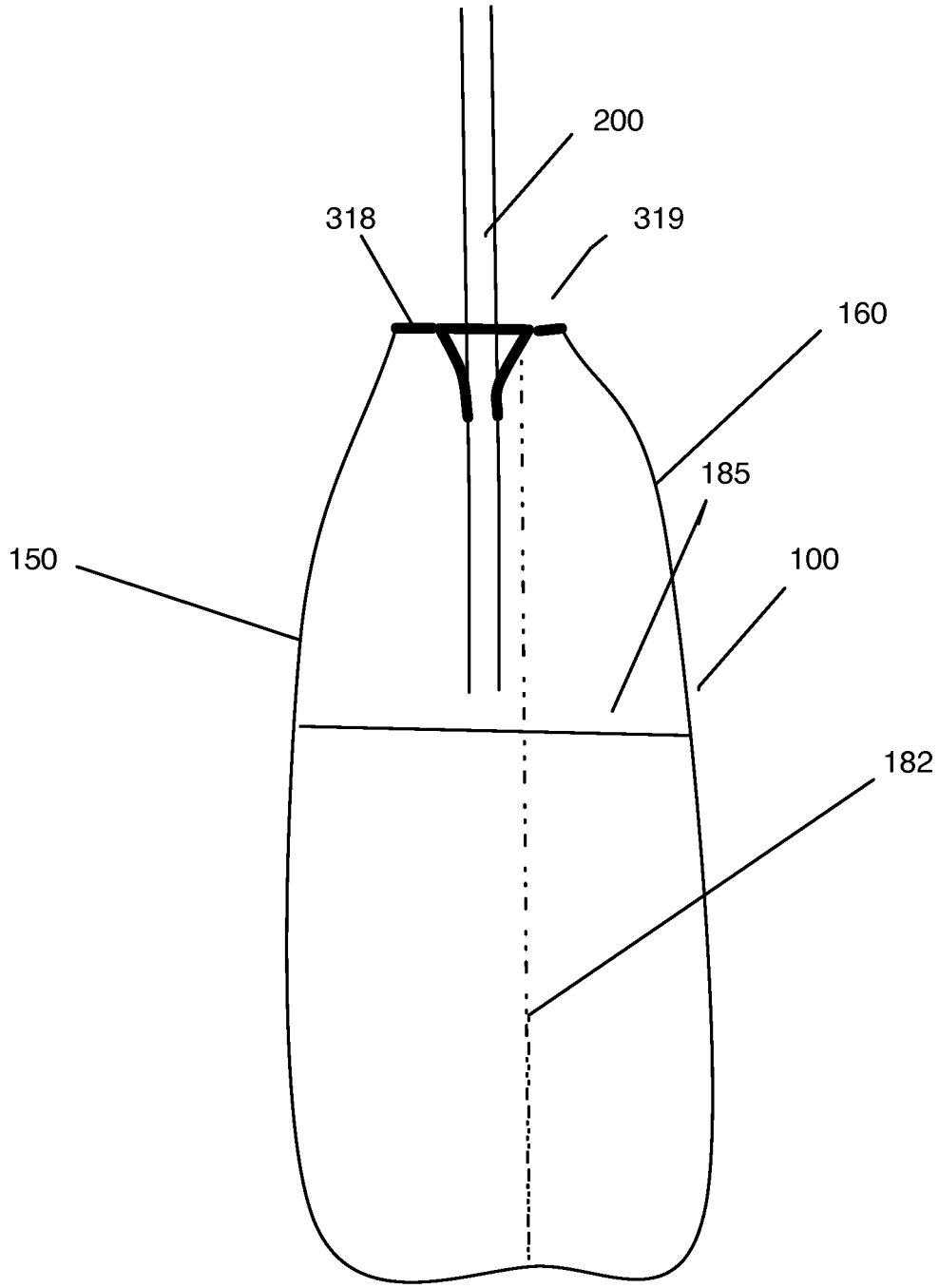
FIG. 8 is a vertical cross section view of the fill tube and fluid storage bag when the fluid storage bag is filled.

FIG. 8 is a vertical cross section view of the fill tube and storage bag when the storage bag is filled showing a liquid level 82 and an air pocket 83. The fill tube is collapsed at this point.

Figure 6:
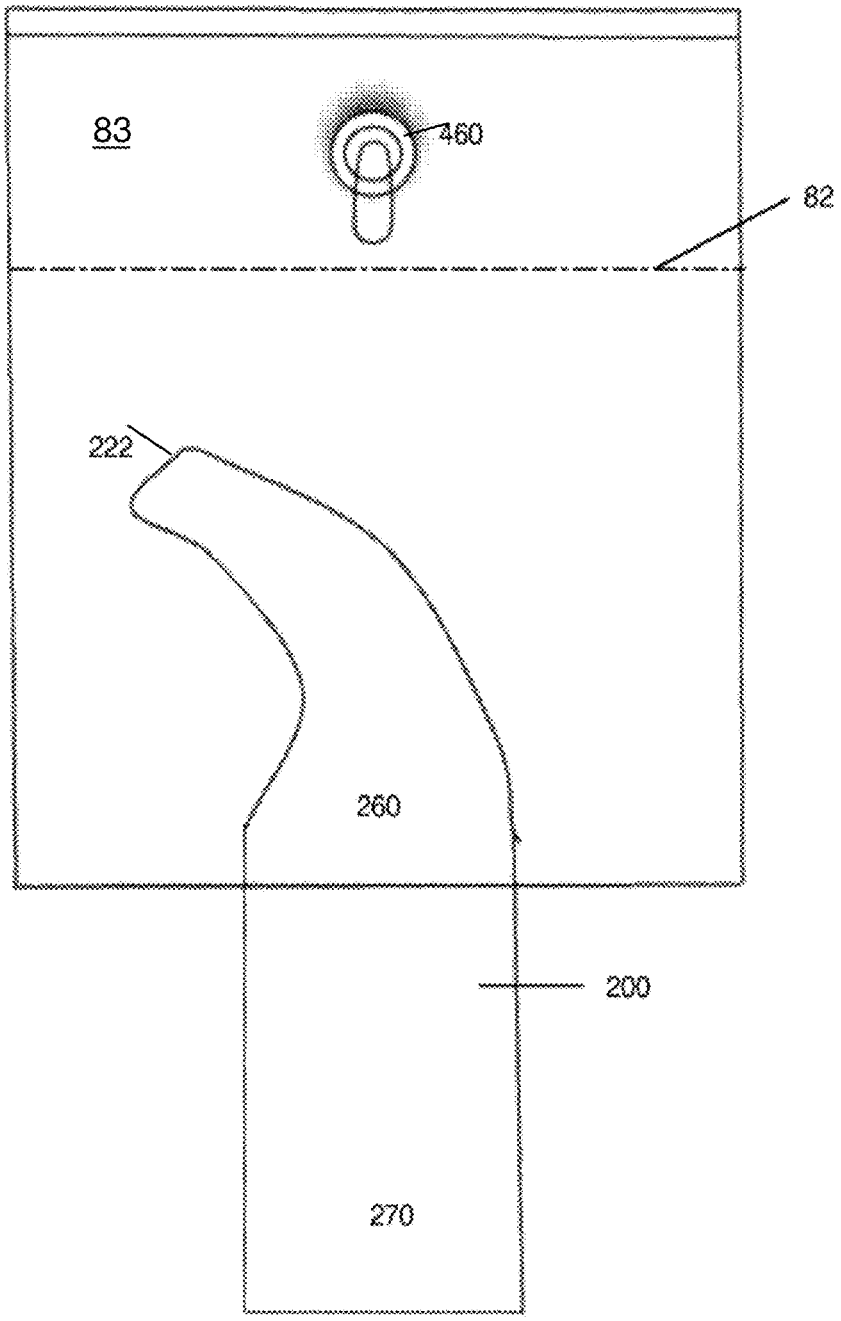
FIG. 6 shows the water container of FIG. 5, quickly inverted or tipped so that the fill tube is sealed.

FIG. 6 shows the storage bag assembly 300 of FIG. 5 with valve 460, quickly inverted so that the fill tube 200 is sealed. When the bag is inverted, and the water level 82 is above the bottom opening 222 of the fill tube 200, the fill tube quickly collapses. The bottom portion 260 of the fill tube can float freely in the liquid that is contained in the storage bag. The effectiveness of the seal was unexpected, and may be promoted by the pressure of the the contents against the lower portion of the fill tube. When the storage bag is quickly inverted, the seal forms very quickly, and remains effective against leaks. Extensive testing has failed to produce a leak through the fill tube in cases of high pressure or vibration and sloshing of the contents. The valve 460 may be used to bleed air when the bag is inverted.

Although FIG. 6 shows an inversion of the storage bag, in other examples, such as a large bag, the fill tube can be collapsed by tilting the bag to submerge the fill tube.

Venting Air

After the inversion and collapse of the fill tube, the storage bag may be positioned on its side so that the access element is above the contents and upwardly-facing, and air may be bled from the bag through the access element. Although it is not necessary to bleed the air from the bag, it is often desirable to bleed some or all of the air to minimize sloshing of liquids or to fit a filled bag into a container such as a backpack. In these cases, the fill operation can be considered as a deliberate overfilling of the storage bag with liquid and air, followed by a removal of air.

Figure 9B:
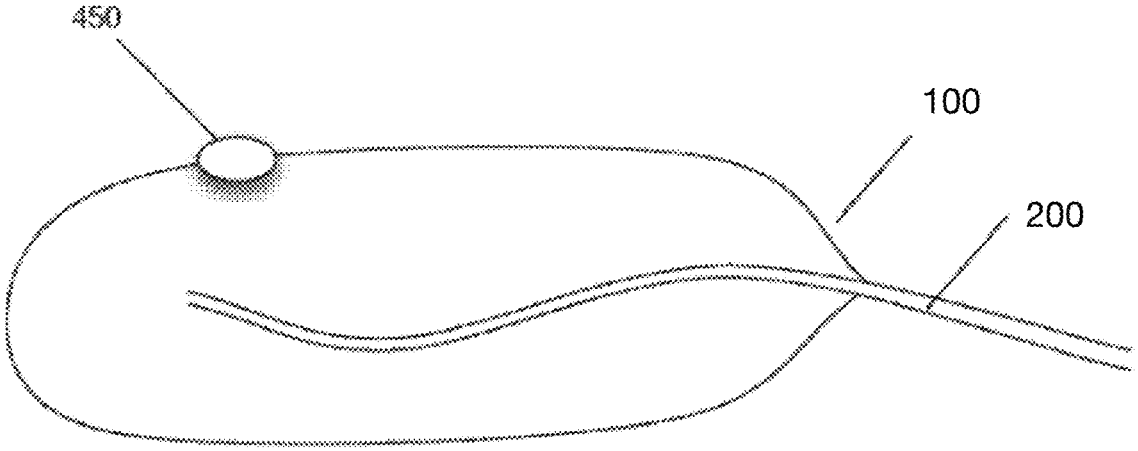
FIG. 9B is a horizontal cross section view of a fill tube and fluid storage bag when the storage bag of FIG. 9A is vented.
Figure 9A:
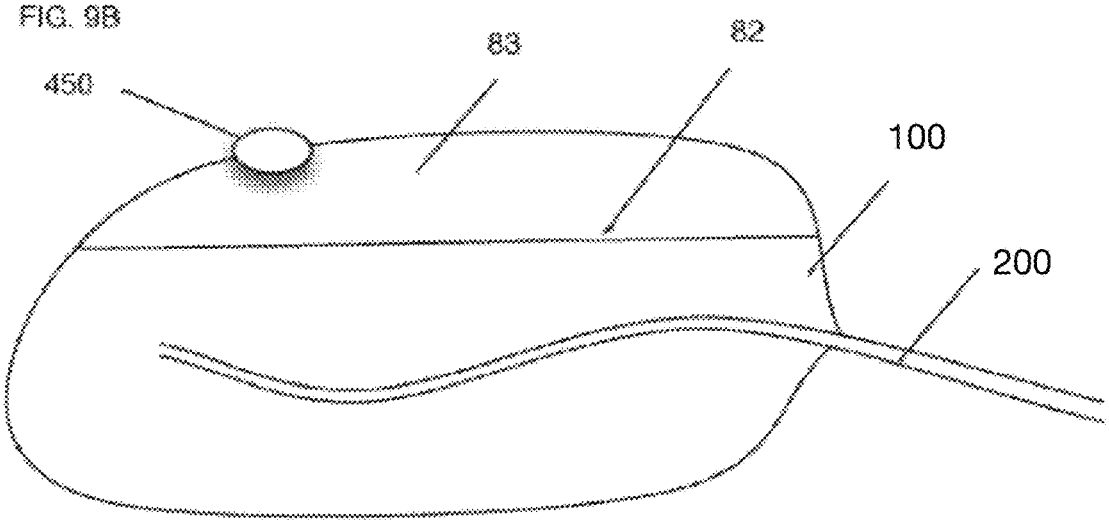
FIG. 9A is a horizontal cross section view of a fill tube and fluid storage bag when the fluid storage bag is filled and laid flat.

FIG. 9A is a horizontal cross section view of the fill tube and storage bag when the storage bag is filled and laid flat.

FIG. 9B is a horizontal cross section view of the fill tube and storage bag when the storage bag of FIG. 9A is partially vented through access element 450.

Primary Fill Tube Sealing

The primary seal on the fill tube is provided when the fill tube collapses after the filling operation.

Secondary Sealing

The bag can have a fold over clip and seal, ziplock-type, or slider mechanism to seal the portion 270 of the fill tube which extends outside of the storage bag.

Example—2.5 Gallon Water Storage Bag with Filter

Figure 11:
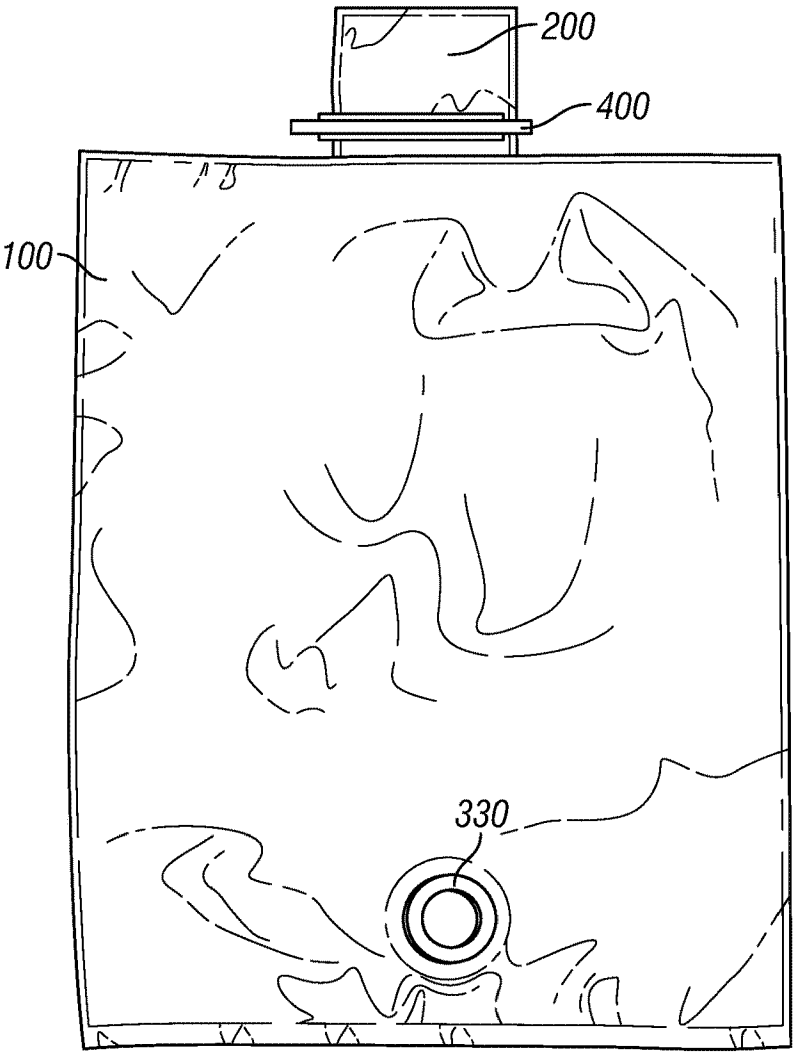
FIG. 11 is a top view of a 2.5 gallon fluid storage bag.
Figure 10:
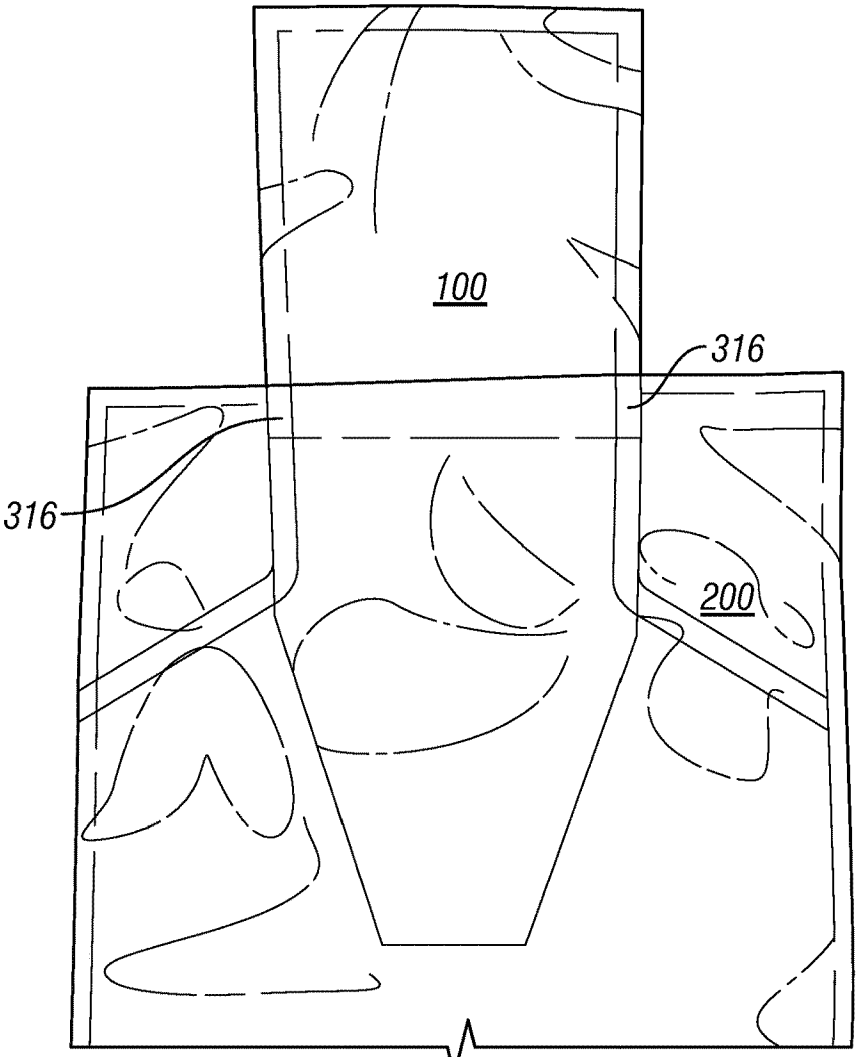
FIG. 10 is a top view of an alternate fluid storage bag with straight inversion prevention seals.

FIG. 11 is a top view of a 2.5 gallon storage bag 100 with a fill port 200. In this example, a secondary clip closure 400 is provided on the fill port, and an outlet port 330 is provided.

FIG. 12 is a top view of a pump 450 with an inlet tube 452, inlet hose 454 and filter housing 456. A filter (not shown) is provided in the filter housing 456.

Figure 13:
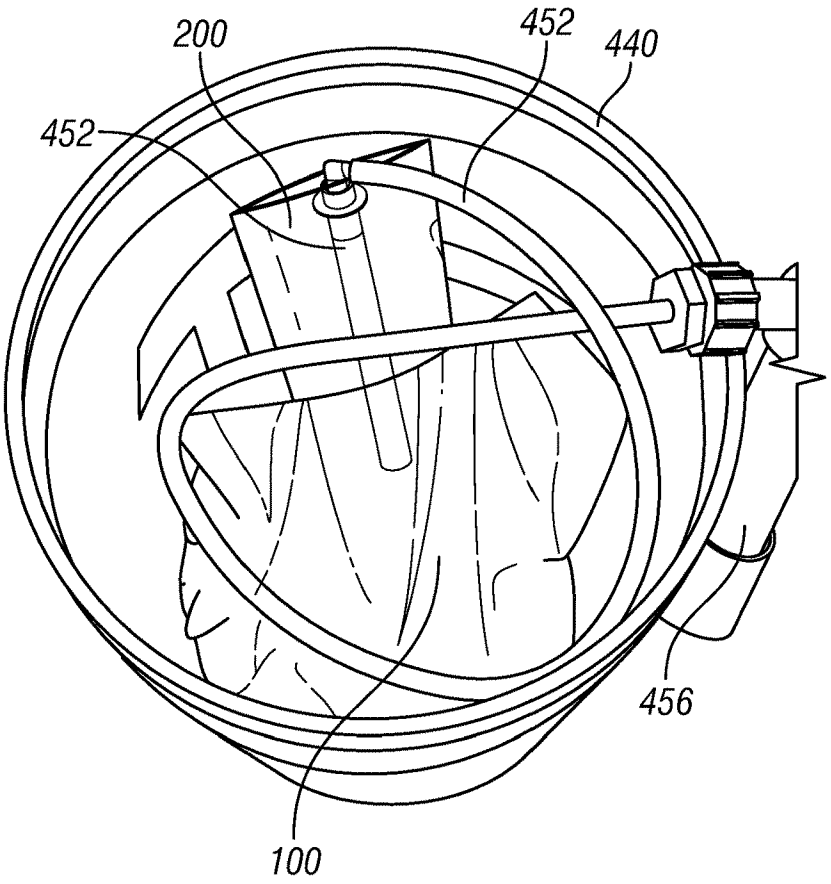
FIG. 13 is a top perspective view of the pump of FIG. 12 with the inlet tube placed on the fill port of a fluid storage bag placed in a bucket.

FIG. 13 is a top perspective view of the pump of FIG. 12 with the inlet tube 452 placed on the fill port 200 of a storage bag 100 placed in a bucket 440. In this example, the storage bag is supported by an open bucket 440 so that the fill tube is accessible from the top of the bucket. Water may be removed from the storage bag by pumping through the inlet tube 452.

Figure 14B:
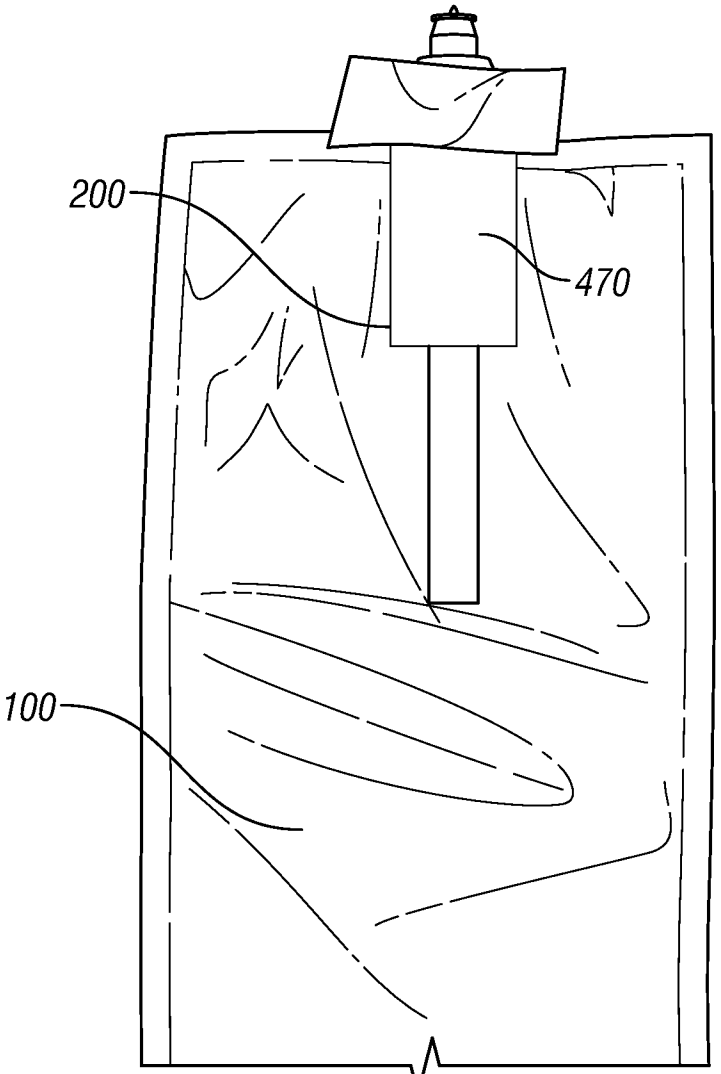
FIG. 14B is a top view of a fluid storage bag with a second example filter positioned in the storage bag fill tube.
Figure 14A:
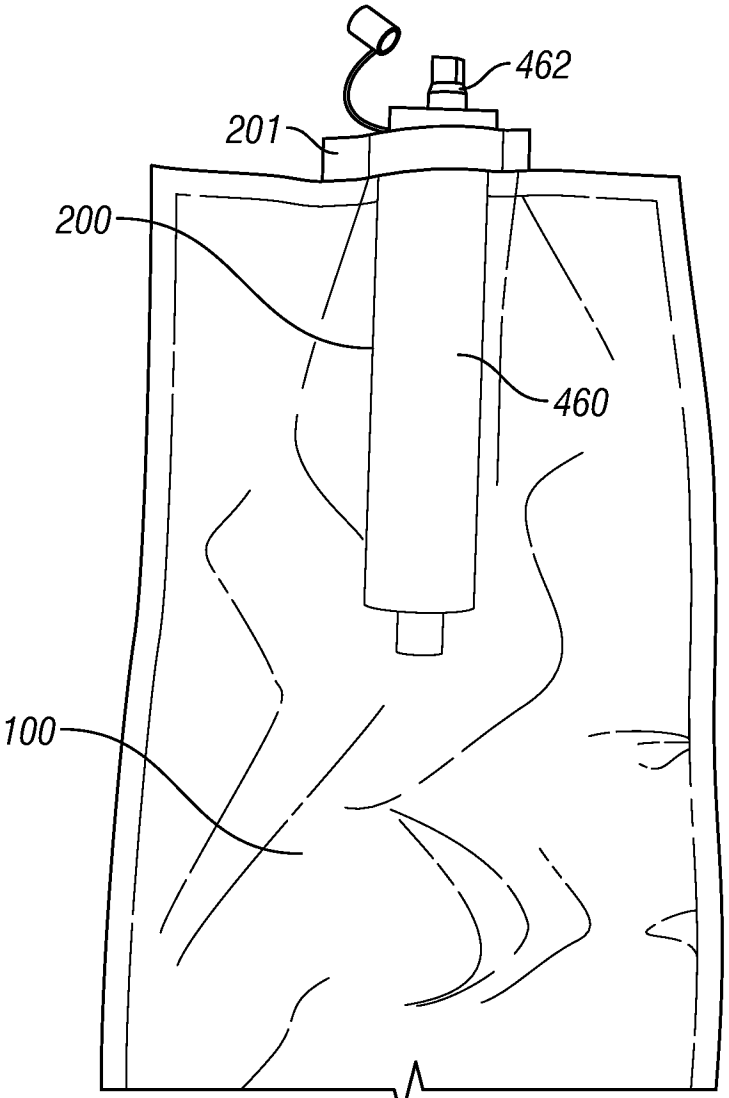
FIG. 14A is a top view of a fluid storage bag with a first example filter positioned in the storage bag fill tube.

FIG. 14A is a top view of a storage bag 100 with a first example filter 460 positioned in the storage bag fill tube 200. In this example, the external portion of the fill tube has been rolled down 201 over the top portion 462 of the filter so that a user may grasp to rolled down portion to seal the fill tube against the top portion of the filter. The bottom portion 463 of the filter extends below the bottom of the fill tube so that the user may suck water out of the storage bag and through the filter. This technique permits the user to have filtered water.

FIG. 14B is a top view of a a storage bag 100 with a second example filter 470 positioned in the storage bag fill tube 200. A user may drink or pour through the filter as described above.

When a liquid is added to the fluid storage bag, the fill tube collapses and seals best when the bag is not completely filled, so that the bag can be turned to permit fluid pressure to seal the fill tube.

When a gas is added to the fluid storage bag, it is best to fill the bag with gas until the internal pressure is greater than the external pressure. When gas flow through the fill tube ceases, the internal pressure in the storage bag will seal the fill tube. When an external pressure is then applied to the bag, such as in use as a flotation device, air mattress, or pillow, the internal pressure will increase, but does not appear to increase gas leakage through the fill tube.

Example—Mixing is a Fluid Storage Bag

In this example, one or more solids or liquids is introduced through the fluid storage bag fill tube. These substances may be added before or after water or other liquid is added to the fluid storage bag. After mixing the components, such as by shaking the fluid storage bag, the mixture may be removed through the fill port, and optional outlet port, or by cutting the bag.

Example—Adding Air or Other Gas to Fluid Storage Bag

In this example air may be added to a fluid storage bag in order to provide a low cost and recyclable container that can serve as a flotation device, raft, air mattress, travel or camping pillow, or other device. Air may be added to the fluid storage bag by blowing through the fill tube. In other examples a pump such as shown in FIG. 12; a compressor; or bicycle pump may be used to add air or gas to the bag.

Large bags with single or multiple compartments may be used to serve as rafts or flotation devices. Other bag sizes may be provided for air mattresses, personal flotation devices, camping or travel pillows, or other devices. After use, the devices may be deflated by puncturing or discharging through the fill tube, and recycled as a single material.

When the fluid storage bag is pressurized with air or other gas, internal bag pressure acts to keep the fill tube closed. Increasing external pressure appears to provide additional pressure on the closed fill tube. This feature permits a simple and inexpensive fluid storage bag to be provided in a wide range of sizes and to serve a number of useful functions and then be completely recycled.

Method of Manufacture

In one method of manufacture, the collapsible fill tube is made from a single length of flat tubing by cutting a bottom funnel shape, and heat sealing side edges of the funnel.

In another method of manufacture, the collapsible fill tube is made from two panels by heat sealing side edges of the first panel as it overlays the second panel.

In one example, the storage bag is provided as an open-top prefabricated bag. A collapsible fill tube is inserted in the bag; and the storage bag top seal is created by heat sealing.

In another example, the storage bag is fabricated from a first side panel and a second side panel. The first side panel has a top edge, a first side edge, a second side edge, and a bottom edge. The second side panel has a top edge, a first side edge, a second side edge, and a bottom edge. The first panel is positioned over the second panel and the first side edge of the first panel is bonded to the first side edge of the second panel; the second side edge of the first panel is bonded to the second side edge of the second panel; and the bottom edge of the first panel is bonded to the bottom edge of the second panel.

In another example, the storage bag is fabricated from a single folded sheet which forms a first portion and a second portion joined at a fold. The single folded panel is folded so that the folded side edges are aligned and bonded; and the folded bottom edges are aligned and bonded. One method of forming a container with a collapsible self sealing fill tube comprises forming a funnel bottom on the section of flat tubing; placing the section of flat tubing with funnel bottom between the first panel and a second panel of a storage bag so that a lower portion of the fill tube extends into the storage bag by a distance greater than the length of the funnel bottom; and sealing a top portion of the storage bag. The sealing is performed by heat sealing an upper portion of the section of flat tubing to the first panel and the second panel in proximity to the top of the storage bag; creating a first storage bag top seal between the first side edge of the storage bag and the section of flat tubing; and creating a second storage bag top seal between the second side edge of the storage bag and the section of flat tubing. In one example, the funnel bottom is formed with a height greater than the flat tubing width, and with a bottom opening width of about half of the flat tubing width.

Alternate Designs

The quick loading/filling bag can be modified in numerous ways to accommodate a variety of needs. The following ideas are suggested, but not limiting:

Disposable, Recyclable, or Reusable Bags

In on example, the storage bag and fill tube assembly is designed to be disposable and recyclable. The locking/dispensing mechanism can be built-in or removable and reused.

In another example, the storage bag and fill tube assembly can be refilled and reused.

Liquid or Solid Storage

The container described above can be sized for various volumes of a liquid. In other examples, varying sizes can contain contain liquids or granular-type solids.

Storage of Bags

The filled storage bags can be placed or stored in anything that can support their weight.

On-Demand Mixing

The invention can accommodate multiple quick loading parts for filling and/or separation of certain materials/liquids, such as epoxies, before combining.

Materials

The invention can be made from a variety of polyethylene, polypropylene and any other flexible materials.

The bag can be constructed of thicker outer materials while inner filling/tubing part is still very flexible and collapsible for filling giving it a check valve type of operation.

Dispensing

The bag storage can connect to a variety of fasteners, tubes and hoses for dispensing. In some applications, the assembly may comprise only a storage bag and a fill tube. In these applications, the contents can be accessed by cutting or otherwise opening the storage bag.

Method of Use

A method of filling and sealing the container comprises introducing a liquid through the top of the collapsible fill tube; continuing to introduce liquid through the collapsible fill tube until a desired liquid level is reached in the storage bag; and permitting the collapsible fill tube to collapse, thereby sealing the container. In one example, the storage bag is inverted so that the bag contents surround the portion of the fill tube which is within the storage bag. This inversion causes the fill tube to collapse and seal.

The following is an example method of use of a container assembly:

At step 1000, a container assembly such as shown in FIG. 4 is provided.

At step 1100, a liquid is introduced though the fill tube of the container assembly.

At step 1200, a liquid is introduced though the fill tube of the container assembly until the level of liquid in the storage bag reaches a desired level.

At step 1300, the container assembly is inverted or tipped, thereby causing the fill tube to collapse and seal.

At step 1400, excess air may be bled from the container.

At step 1500, the filled container may be stored or transported.

At step 1600, the contents of the container may be accessed.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A fluid storage container comprising a storage bag comprising a top portion, and a bottom portion; and a collapsible self-sealing tube positioned partially within the storage bag, the collapsible self-sealing tube comprising a first panel having an inside surface, a first side edge, and a second side edge, a second panel having an inside surface, a first side edge, and a second side edge, a first fill tube side edge, a second fill tube side edge, such that the first panel is connected to the second panel at the first fill tube side edge and the second fill tube side edge, a top having a width, and a tapered funnel-shaped bottom portion having a bottom opening with a width less than the top width, the collapsible self-sealing tube having a collapsed state with the inside surface of the first panel in substantial contact with the inside surface of the second panel, and an open state with the inside surface of the first panel spaced apart from the inside surface of the second panel, such that an upper portion of the collapsible self-sealing tube extends through the top portion of the storage bag and a lower portion of the collapsible self-sealing tube is positioned within the storage bag, and a storage bag top seal is provided, in proximity to the top of the storage bag, between the storage bag and the collapsible fill tube, and such that the fluid storage container is configured to hold a liquid or gas; and a pair of inversion preventers configured to retain the tapered funnel-shaped bottom portion of the collapsible self-sealing tube within the storage bag, each inversion preventer having an upwardly-convex section or a straight section between a first point on the lower portion of the collapsible self-sealing tube and a second point on the top portion of the storage bag.

2. The fluid storage container of claim 1 wherein the collapsible self-sealing tube has a length of about 9 inches and a top width of about 4 inches; about 6 inches of the collapsible self-sealing tube extends into the storage bag; and the tapered funnel shaped bottom portion of the self-sealing fill tube has a length of about 5 inches and a bottom opening width of about 2 inches.

3. The fluid storage container of claim 1 wherein the collapsible self-sealing tube comprises a single length of flat tubing.

4. The fluid storage container of claim 1 wherein the further fill tube inversion preventers further comprise a first upwardly-convex inversion seal; and a second upwardly-convex inversion seal.

5. The fluid storage container of claim 1 further comprising an access port and stopper; or an access port and valve.

6. The fluid storage container of claim 1 further comprising a two-part closure.

7. The fluid storage container of claim 1 further comprising a tear-away portion.

8. A method of filling and sealing a fluid storage container, the method comprising providing a first fluid storage container consisting of a storage bag comprising a top portion, and a bottom portion, and a collapsible self-sealing tube with an upper portion extending through the top portion of the storage bag and a lower portion positioned within the storage bag, the collapsible self-sealing tube comprising a funnel-shaped bottom portion, such that a storage bag top seal is provided, in proximity to the top of the storage bag, between the storage bag and the collapsible self-sealing tube, and a pair of inversion preventers configured to retain the tapered funnel-shaped bottom portion of the collapsible self-sealing tube within the storage bag, each inversion preventer having an upwardly-convex section or a straight section between a first point on the lower portion of the collapsible self-sealing tube and a second point on the top portion of the storage bag;

introducing a fluid through the top of the collapsible self-sealing tube; and permitting the collapsible self-sealing tube to collapse, thereby sealing the fluid storage container.

9. The method of claim 8 wherein introducing a fluid through the top of the collapsible self-sealing tube further comprises introducing a liquid into the storage bag, and partially filling the storage bag with the liquid; and permitting the collapsible self-sealing tube to collapse further comprises inverting the storage bag so that the bag contents surround the portion of the collapsible self-sealing tube which is within the storage bag.

10. The method of claim 9 further comprising inserting a filter or filter inlet element into the collapsible fill tube; and withdrawing liquid from the storage bag through the filter or filter element.

11. The method of claim 8 wherein introducing a fluid through the top of the collapsible fill tube further comprises introducing a gas into the storage bag, and filling the storage bag with the gas until an internal pressure in the storage bag exceeds a pressure external to the storage bag; and permitting the collapsible fill tube to collapse further comprises allowing the internal pressure to seal the collapsible fill tube.

* * * * *